US011441210B2

(12) United States Patent
Vincent et al.

(10) Patent No.: US 11,441,210 B2
(45) Date of Patent: Sep. 13, 2022

(54) TIMEPIECE OR PIECE OF JEWELLERY OR GEMSTONE JEWELLERY MADE OF GOLD

(71) Applicant: Omega SA, Biel/Bienne (CH)

(72) Inventors: Denis Vincent, Neuchatel (CH); Gregory Kissling, La Neuveville (CH); Christian Charbon, Chezard-St-Martin (CH); Vincent Fays, Saint-Blaise (CH); Stephane Lauper, Cortaillod (CH)

(73) Assignee: Omega SA, Biel/Bienne (CH)

( * ) Notice: Subject to any disclaimer, the term of this patent is extended or adjusted under 35 U.S.C. 154(b) by 282 days.

(21) Appl. No.: 16/841,738

(22) Filed: Apr. 7, 2020

(65) Prior Publication Data

US 2021/0054483 A1 Feb. 25, 2021

(30) Foreign Application Priority Data

Aug. 23, 2019 (EP) ..... 19193469

(51) Int. Cl.

| | |
|---|---|
| ***C22C 30/02*** | (2006.01) |
| ***C22C 9/00*** | (2006.01) |
| ***G04B 37/22*** | (2006.01) |
| ***A44C 27/00*** | (2006.01) |
| ***C22C 5/02*** | (2006.01) |

(52) U.S. Cl.

CPC ..... *C22C 30/02* (2013.01); *A44C 27/003* (2013.01); *C22C 5/02* (2013.01); *C22C 9/00* (2013.01); *G04B 37/22* (2013.01)

(58) Field of Classification Search

CPC ..... C22C 5/02

See application file for complete search history.

(56) References Cited

U.S. PATENT DOCUMENTS

| | | | | |
|---|---|---|---|---|
| 3,136,633 | A | 6/1964 | Berry | |
| 3,892,564 | A * | 7/1975 | Hatswell | A61K 6/844 420/587 |
| 4,276,086 | A * | 6/1981 | Murao | C22C 9/00 420/587 |
| 10,471,486 | B2 * | 11/2019 | Vincent | C22C 5/02 |
| 10,638,819 | B2 * | 5/2020 | Zito | C22C 1/0466 |
| 2017/0128992 | A1 | 5/2017 | Vincent et al. | |

FOREIGN PATENT DOCUMENTS

| | | | | |
|---|---|---|---|---|
| BE | 436 287 | A | 10/1939 | |
| CH | 709 923 | A2 | 1/2016 | |
| CN | 103002858 | A | 3/2013 | |
| CN | 106676368 | A | 5/2017 | |
| DE | 39 35 813 | A1 | 5/1991 | |
| EP | 1 650 316 | A1 | 4/2006 | |
| EP | 2045343 | A1 * | 4/2009 | C22C 30/02 |
| EP | 3 165 621 | A1 | 5/2017 | |
| FR | 2 275 271 | A1 | 1/1976 | |
| FR | 2 305 503 | A1 | 10/1976 | |
| JP | 56-69338 | A | 6/1981 | |
| JP | 64-62296 | A | 3/1989 | |
| JP | 2002-191421 | A | 7/2002 | |
| SI | 23418 | A | 1/2012 | |
| WO | WO 2015/173790 | A1 | 11/2015 | |
| WO | WO 2015/193659 | A2 | 12/2015 | |

OTHER PUBLICATIONS

Machine translation of JP 64-62296 A (Year: 1989).*

European Search Report dated Oct. 31, 2019 in European Application 19193469.4 filed on Aug. 23, 2019 (with English Translation of Categories of Cited Documents), 4 pages.

Japanese Office Action dated Jun. 8, 2021 in Japanese Patent Application No. 2020-0655415 (with English translation), 9 pages.

Combined Chinese Office Action and Search Report dated Sep. 1, 2021 in Chinese Patent Application No. 202010849214.1 (with English Translation of Category of Cited Documents), 8 pages.

Combined Chinese Office Action and Search Report dated Sep. 1, 2021 in Chinese Patent Application No. 202010849214.1 (with English Tnanslation of Category of Cited Documents), 8 pages.

Jui Qinghua, et al. "The Great Exploration of Metal Elements", Beijing: Metallurgical Industry Press, Mar. 31, 2018, 3 pages (With Partial English translation).

Xu Zhi, "Precious Metal Materials and Jewelry Production,", Shanghai People's Fine Arts Publishing House, Jan. 31, 2014, 3 pages (with Partial English translation).

* cited by examiner

*Primary Examiner* — Christopher S Kessler

(74) *Attorney, Agent, or Firm* — Oblon, McClelland, Maier & Neustadt, L.L.P.

(57) ABSTRACT

A zinc-free gold alloy containing by weight between 37% and 38.5% of gold, between 4 and 32% of palladium and/or silver, between 25% and 54% of copper and between 0% and 10% of gallium. A timepiece or piece of jewellery or gemstone jewellery made of this alloy.

14 Claims, No Drawings

TIMEPIECE OR PIECE OF JEWELLERY OR GEMSTONE JEWELLERY MADE OF GOLD

CROSS-REFERENCE TO RELATED APPLICATION

This application claims priority to European Patent Application No. 19193469.4 filed on Aug. 23, 2019, the entire disclosure of which is hereby incorporated herein by reference.

FIELD OF THE INVENTION

The invention concerns a 9 carat gold alloy with good deformability, as well as improved stress corrosion resistance and tarnishing resistance.

The invention concerns a timepiece or piece of jewellery gemstone jewellery made of this gold alloy.

BACKGROUND OF THE INVENTION 9 carat gold alloys mostly contain zinc for reasons of lustre. Unfortunately, most of these alloys are sensitive to stress corrosion according to the publication 'Stress Corrosion in Gold Alloys' by Jennifer M. M. Dugmore and Charles D. DesForges. In the field of horology, these alloys crack in the open air and can no longer be rolled to the desired dimensions. In the field of jewellery/gemstone jewellery and in the particular case of setting stones, these alloys can no longer be crimped, since a stone could be lost.

Zinc unfortunately has the drawback of polluting furnaces during casting and recrystallisation annealing. This is annoying for gold refiners who are continuously subject to constant cleaning of their furnaces to avoid contamination on other alloys.

In the field of luxury horology/jewellery/gemstone jewellery, these alloys are therefore little used, even though they have the advantage of being being less expensive than 18 carat gold alloys of identical colour.

To our knowledge, there is no alloy on the 9 carat gold market that has been developed with improved tarnishing, deformability and stress corrosion resistance properties compared to standard gold alloys on the market.

SUMMARY OF THE INVENTION

It is thus an object of the present invention to overcome the drawbacks of the aforementioned prior art by providing a 9 carat gold alloy, with improved tarnishing resistance, deformability and stress corrosion resistance compared to coloured 9 carat gold alloys of the prior art.

It is also an object of the invention to provide a zinc-free 9 carat gold alloy, in order to facilitate the implementation thereof.

To this end, the invention concerns a zinc-free gold alloy containing by weight between 37.5% and 38.5% of gold, between 4% and 32% of silver and/or palladium, between 25.0% and 54.0% of copper and between 0 and 10.0% of gallium.

Advantageously, the invention concerns a gold alloy containing by weight from 37.5% to 38.5% of gold, from 4% to 32% of silver and/or palladium, from 25.0% to 54.0% of copper, from 0 to 10.0% of gallium and from 0 to 0.05% of an element selected from among iridium, rhenium and ruthenium.

The present invention also relates to the timepiece or piece of jewellery or gemstone jewellery made from this alloy.

It was observed that timepieces or pieces of jewellery or gemstone jewellery made with this alloy are very advantageous in terms of their colour, their deformability and their resistance to corrosion (especially stress corrosion) and to tarnishing.

In terms of colour, they have an attractive colour close to that of bronze but without the drawbacks related to oxidation of that material.

DESCRIPTION OF THE INVENTION

The present invention relates to a zinc-free gold alloy more particularly intended for application in the field of horology or jewellery or gemstone jewellery. It thus also concerns the timepieces or pieces of jewellery or gemstone jewellery made of this alloy. 'Timepieces' is used to mean both external components, such as a case, a dial, a dial applique, a bracelet, etc. and movement components, such as a plate, a bar or a balance.

The gold alloy according to the invention contains by weight between 37.5% and 38.5% of gold, silver and/or of palladium with a total of these two elements comprised between 4 and 32%, between 25.0% and 54.0% of copper and between 0 and 10% of gallium. It has the peculiarity of being zinc-free. It is also nickel-free, cobalt-free, iron-free and manganese-free.

Advantageously, the gold alloy contains between 5 and 26 wt. % of silver and/or palladium.

Preferably, the gold alloy contains between 6 wt. % and 19.5 wt. % of silver and/or palladium.

More preferably, the gold alloy contains between 7 wt. % and 17 wt. % of silver and/or palladium.

In a particularly preferred manner, the gold alloy contains between 7 wt. % and 14.5 wt. % of silver and/or palladium.

Further, the gold alloy contains between 0 and 0.05 wt. % (inclusive) of an element selected from among iridium, rhenium and ruthenium and advantageously the alloy contains 0.0025 wt. % of iridium.

To prepare the gold alloy, the various elements of the composition are melted before being cast. The casting ingot is then deformed with a work hardening rate higher than or equal to 75% in several passes with intermediate annealing treatments performed at a temperature of 650° C. for 30 minutes. After cooling, the blanks are dimensioned, for example by machining.

The alloys obtained after deformation and annealing have in the CIELAB colour space (in accordance with the following standards: CIE No. 15, ISO 7724/1, DIN 5033-7, ASTM E-1164) an a* value comprised between 1 and 8, preferably between 5.5 and 7.5, and a b* value comprised between 12 and 18, preferably between 14 and 16.

They have a hardness comprised between 125 and 180 HV1, preferably between 130 and 180 HV1. They have an electrochemical potential greater than or equal to 0.52 volts, the latter being obtained by adding together the electrochemical potential of each element of the alloy multiplied by its atomic concentration.

Table 1 shows the composition by ‰ weight of the following alloys available on the market: No. 843, No. 844 and No. 859 containing zinc, and two laboratory alloys No. 846 and No. 848 containing zinc, these five alloys being comparative examples. Zinc-free alloys Nos. 849-852, 854-858 and 860 are 9 carat gold alloys according to the invention. The measured colorimetric values, the measured hardnesses (HV1) and the calculated electrochemical potentials are also set out in Table 1. The colorimetric L*a*b* values were measured with a KONICA MINOLTA CM-2600d spectrophotometer with a D65 illuminant and an angle of observation of 10°.

TABLE 1

| | | Compositions [‰weight] | | | | | | Hardness | $E_0$ | Colorimetry (D65, 10°) | | |
|---|---|---|---|---|---|---|---|---|---|---|---|---|
| | | Cu. | Zn. | Ga. | Pd. | Ag. | Au. | [HV1] | [Volts] | L* | a* | b* |
| 843 | Comparison | 423.5 | 109.0 | | | 92.0 | 375.5 | 113 | 0.407 | 91.5 | 0.7 | 20.3 |
| 844 | | 376.0 | 114.0 | | | 134.0 | 376.0 | 133 | 0.418 | 91.9 | −0.2 | 20.0 |
| 846 | | 293.0 | 40.0 | | | 291.0 | 376.0 | 170 | 0.621 | 92.1 | 2.2 | 15.8 |
| 848 | | 346.8 | 77.2 | | | 200.0 | 376.0 | 179 | 0.508 | 92.0 | 0.9 | 17.8 |
| 859 | | 573.0 | 24.0 | | | 27.0 | 376.0 | * | 0.504 | * | * | * |
| 849 | Invention | 311.0 | | 22.0 | | 291.0 | 376.0 | 153 | 0.661 | 91.9 | 2.4 | 14.3 |
| 851 | | 384.0 | | 40.0 | | 200.0 | 376.0 | 162 | 0.584 | 90.8 | 2.6 | 16.1 |
| 852 | | 311.0 | | 22.0 | 20.0 | 271.0 | 376.0 | 170 | 0.665 | 90.5 | 3.0 | 13.0 |
| 854 | | 384.0 | | 40.0 | 20.0 | 180.0 | 376.0 | 171 | 0.588 | 89.8 | 3.3 | 14.7 |
| 855 | | 450.0 | | 40.0 | 20.0 | 114.0 | 376.0 | 152 | 0.552 | 88.6 | 4.9 | 15.2 |
| 856 | | 500.0 | | 40.0 | 20.0 | 64.0 | 376.0 | 131 | 0.526 | 87.1 | 6.7 | 15.0 |
| 857 | | 425.0 | | 40.0 | 20.0 | 139.0 | 376.0 | 164 | 0.565 | 87.1 | 5.7 | 16.6 |
| 858 | | 400.0 | | 40.0 | 20.0 | 164.0 | 376.0 | 163 | 0.579 | 87.3 | 5.2 | 16.4 |
| 860 | | 500.0 | | 40.0 | | 84.0 | 376.0 | * | 0.523 | * | * | * |

* not measured

These calculations and tests clearly show that the alloys according to the invention have good corrosion resistance (electrochemical potential above 0.52 volts), as well as hardness in the annealed state that easily allows the deformation thereof (between 130 and 175 HV). They all have an a* value within the range of 2-7 and a b* value in the range of 13-18. In particular, alloy 856 has a 4N shade according to standard ISO 8654: 2019.

The invention claimed is:

1. A zinc-free gold alloy containing by weight between 37.5% and 38.5% of gold; palladium and/or silver in a total percentage comprised between 4% and 32%, between 39% and 54% of copper and between 0% and 10% of gallium.

2. The gold alloy according to claim 1, wherein said alloy contains by weight between 37.5% and 38.5% of gold; palladium and/or silver in a total percentage comprised between 5% and 26%, between 39% and 53% of copper and between 0% and 8.5% of gallium.

3. The gold alloy according to claim 1, wherein said alloy contains by weight between 37.5% and 38.5% of gold; palladium and/or silver in a total percentage comprised between 6% and 19.5%, between 39% and 52% of copper and between 2% and 7% of gallium.

4. The gold alloy according to claim 1, wherein said alloy contains by weight between 37.5% and 38.5% of gold; palladium and/or silver in a total percentage comprised between 7% and 17%, between 41% and 52% of copper and between 7% and 6% of gallium.

5. The gold alloy according to claim 1, wherein said alloy contains by weight between 37.5% and 38.5% of gold; palladium and/or silver in a total percentage comprised between 7% and 14.5%, between 44% and 51% of copper and between 2% and 6% of gallium.

6. The gold alloy according to claim 1, wherein said alloy contains by weight between 37.5% and 38.5% of gold, between 0 and 5% of palladium, between 4 and 27% of silver, between 39% and 54% of copper and between 0% and 10% of gallium.

7. The gold alloy according to claim 1, wherein said alloy contains by weight between 37.5% and 38.5% of gold, between 0% and 5% of palladium, between 4% and 12% of silver, between 45% and 51% of copper and between 3% and 5% of gallium.

8. The gold alloy according to claim 7, wherein said alloy contains 2 wt. % of palladium.

9. The gold alloy according to claim 1, wherein said alloy contains by weight a maximum of 0.05% of an element selected from among iridium, rhenium and ruthenium.

10. The gold alloy according to claim 1, wherein said alloy is free of nickel, cobalt, iron and manganese.

11. The gold alloy according to claim 1, wherein in the CIELAB colour lab space said alloy has an a* value comprised between 1 and 8 and a b* value comprised between 12 and 18.

12. The gold alloy according to claim 1, wherein in the CIELAB colour lab space said alloy has an a* value comprised between 5.5 and 7.5 and a b* value comprised between 14 and 16.

13. The gold alloy according to claim 1, wherein said alloy has a hardness HV1 comprised between 125 and 180.

14. A timepiece or piece of jewellery or gemstone jewellery made of a Zinc-free gold alloy containing by weight between 37.5% and 38.5% of gold; palladium and/or silver in a total percentage comprised between 4% and 32%, between 39% and 54% of copper and between 0% and 10% of gallium.

* * * * *